United States Patent [19]

Loomis

[11] 4,095,344

[45] Jun. 20, 1978

[54] SCRIBE TOOL AND MOUNT THEREFOR

[76] Inventor: James W. Loomis, 2125 Palmer Dr., St. Helena, Calif. 94574

[21] Appl. No.: 717,410

[22] Filed: Aug. 24, 1976

[51] Int. Cl.[2] ..... B43L 13/00

[52] U.S. Cl. ..... 33/18 R; 33/32 C

[58] Field of Search ..... 33/18 R, 19 A, 32 R, 33/32 C; 30/164.9; 125/39, 36, 38

[56] References Cited

U.S. PATENT DOCUMENTS

| | | | |
|---|---|---|---|
| 1,271,224 | 7/1918 | Rintelman | 274/38 |
| 2,421,926 | 6/1947 | Coronel | 125/39 |
| 3,108,381 | 10/1963 | Kuebler | 33/32 C |
| 3,680,213 | 8/1972 | Reichert | 33/18 R |

*Primary Examiner*—Harry N. Haroian

[57] ABSTRACT

A scribe tool having a shank with a diamond head at one end and a transverse bar at the opposite end. The bar is oriented parallel to a pair of aligned scribe edges on the diamond head. The tool is to be removably carried by a tool holder which includes a tube disposed in an inclined position to a generally horizontal beam, the latter being secured at one end to a floating arm having a slot therethrough for permitting the tube to extend therethrough. The opposite end of the beam is adjustable by means of a screw carried by the arm. The tube has a plate mounted on the upper end thereof and the plate has uniformly spaced, radial arms provided with projections having surfaces engageable be the bar on the tool shank. The surfaces of the projections of diametrically opposed radial arms being coplanar and adapted to engage the bar when the shank of the tool extends through the tube of the tool holder, thereby orienting the scribe edges of the diamond head relative to the longitudinal axis of the floating arm and thereby the desired scribe direction.

22 Claims, 7 Drawing Figures

SCRIBE TOOL AND MOUNT THEREFOR

This invention relates to improvements in scribing machines and, more particularly to an improved diamond headed scribe tool and tool mount for use with such a machine.

BACKGROUND OF THE INVENTION

The scribe tool of a conventional scribing machine for scribing semiconductor wafers is comprised of a relatively long shank provided with a diamond head at the normally lowermost end thereof. The diamond head, during manufacture of the tool, is lapped and polished to provide the necessary facets therefor so that the side margins of certain facets will present scribe edges that can be used to scribe an article when the tool is secured to a floating arm of the scribing machine.

It is extremely important that the facets of the diamond head be properly oriented with respect to the direction of movement of the floating arm relative to the wafer to be scribed to prevent creation of lateral stresses in the wafer which cause fractures in the structure thereof transverse to the desired scribe line. These fractures propagate through the wafer and destroy its structural integrity. As a result, some of the semiconductor chips which are obtained when the scribed wafer is broken will be imperfect and not usable. Thus, the yield from a particular wafer is minimized.

To avoid this problem, attempts have been made to provide some type of correlation between the locations of the scribe edges of the diamond head and the way in which the shank of the tool is mounted on or secured to the floating arm. For instance, flats on the shank have been used as the reference surfaces for aligning the facets of the head. However, this technique lacks the latent precision needed for radial orientation resulting in improper alignment of the scribe edges relative to the direction of tool movement relative to the article to be scribed.

A need has, therefore, arisen for improvements in either or both the scribe tool and the tool mount of a scribing machine to avoid the errors in alignment of the scribe edges of the tool relative to a desired scribe direction to thereby avoid structural damage to the article to be scribed and, in the case of semiconductor wafers, to increase the yield from a particular wafer.

SUMMARY OF THE INVENTION

The present invention satisfies the foregoing need by providing an improved scribe tool and a mount for the tool itself wherein the tool can be properly positioned accurately and easily by the most unskilled worker, yet the scribe edges of the tool will be properly aligned relative to the direction of scribing to thereby substantially eliminate all errors arising from misalignment of the scribe edges of the tool. This is accomplished by permitting the shank of the tool to be mounted on the floating arm of a scribing machine in precisely the same orientation of the shank when connected to a predetermined reference mount, the latter being used during formation of the scribe edges by lapping and polishing techniques. This assures repeatability of tool mounting and provides for precision in the placement of the scribe edges of the diamond head relative to the desired direction of movement of the floating arm relative to the article to be scribed when the tool is mounted thereon. The result, in the case of scribing of semiconductor wafers, will be an increase in the yield of the given wafer over that obtainable with the use of conventional tools and mounting devices therefor.

The tool itself is provided with a bar on the normally upper end of the shank, the diamond head being on the lower end of the shank. The bar is perpendicular to the shank and is transversely circular. The shank is radial to the bar intermediate the ends of the latter. In manufacturing the tool, the bar is oriented so that it is parallel to the common plane of a first pair of aligned scribe edges of the diamond head and perpendicular to the common plane of the second pair of scribe edges.

The tool mount includes a tool holder on the floating arm with the tool holder including a tube for receiving the tool shank. The tube is carried by a beam secured at one end to the floating arm and adjustable in position at its opposite end by an additional screw carried by the arm. The tube is inclined relative to the beam and extends through the latter and through a slot in the floating arm. The bar on the tool shank is engageable with surface means secured to the tube itself. The surface means includes surfaces on first and second pairs of projections secured to respective radial arms on a plate rigid to the upper end of the tube, with the surfaces of each pair of diametrically opposed projections being coplanar to each other. and the plane of one pair of surfaces being perpendicular to the plane of the other pair of surfaces.

The bar on the tool shank is adapted to engage simultaneously the inclined surfaces of one pair of projections so that a corresponding scribe edge of the diamond head will be properly aligned relative to the desired scribe direction. By changing the location of the tool so that the bar engages the surfaces of the second pair of projections, another scribe edge of the diamond head will be in alignment with the scribe direction. For four scribe edges of the diamond head, the tool can be oriented in four different rotative positions on the tool holder.

The primary object of this invention is to provide an improved tool and tool mount wherein the tool can be used on a scribing machine to scribe articles, such as semiconductor wafers or the like, in a manner to assure proper alignment of a scribe edge of the tool relative to the desired direction of scribing and to eliminate damage to the scribed article due to misalignment of the scribe edge.

Another object of this invention is to provide a tool and tool mount of the type described wherein the tool and tool mount have cooperating surface means which is prealigned to assure immediate and precise orientation of a scribe edge of the tool relative to the desired scribe direction when the tool is coupled to the mount in preparation for a scribing operation.

Other objects of this invention will become apparent as the following specification progresses, reference being had to the accompanying drawings for an illustration of an embodiment of the tool and tool mount.

Figure 3:
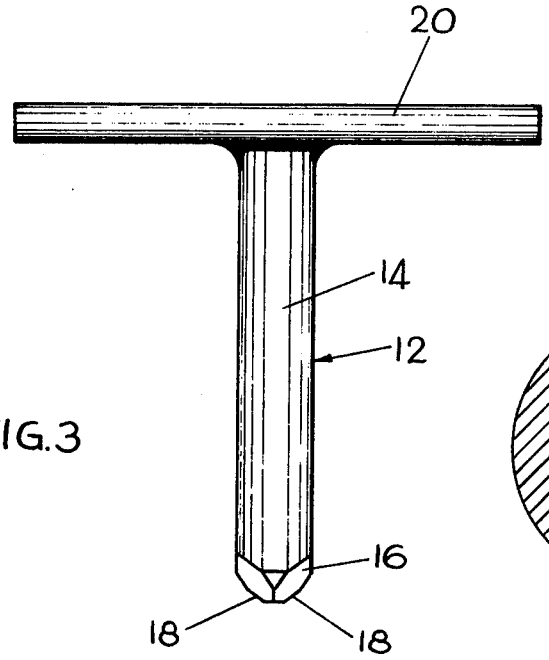
FIG. 3 is a side elevational view of the tool.
Figure 5:
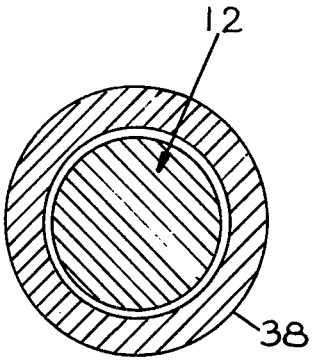
FIG. 5 is a cross-sectional view taken along line 5—5 of FIG. 2.

The tool mount of the present invention is broadly denoted by the numeral 10 and is adapted for use in mounting an improved scribe tool 12 on a scribing machine, such as a machine for scribing semiconductor wafers. Tool 12 includes a cylindrical shank 14 having a diamond head 16 at one end thereof, head 16 having a number of facets (not shown) defining four scribing edges 18, only three of which are shown in FIG. 3. Tool 12 has a bar 20 of transversely circular cross section secured to the opposite end of shank 12, such as by welding, brazing, soldering or the like. Shank 14 is located substantially midway between the ends of bar 20 and projects radially therefrom. Typically, the length of shank 14 and head 16 is about 0.75 inch, the diameter of the shank is about 0.118 inch, and the length and diameter of bar 20 are about 0.875 inch and 0.0625 inch, respectively.

Figure 1:
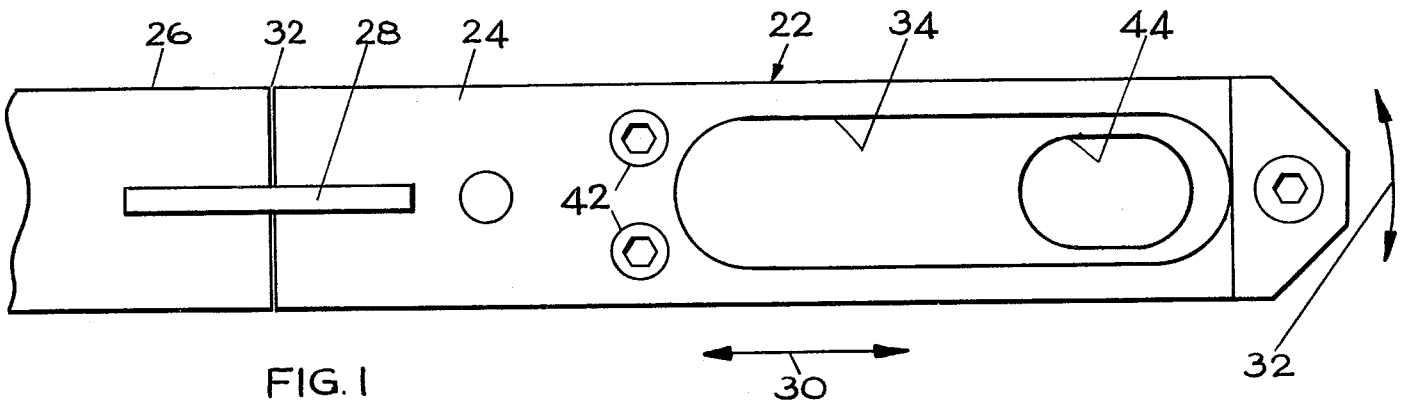
FIG. 1 is a top plan view of a floating arm of a scribing machine for mounting a scribe tool in accordance with the present invention.

A floating arm 22 adapted to be mounted on the scribing machine has a first segment 24 and a second segment 26 connected to segment 24 by a spring or flexure member 28 which, for purposes of illustration, is of generally rectangular shape (FIG. 1). A gap 32 separate segments 24 and 26. Arm 22, when mounted on the scribing machine, reciprocates in the direction of arrows 30 (FIG. 1) along the longitudinal axis of the arm relative to an article to be scribed, such as a semiconductor wafer. In the alternative, arm 22 can be stationary and the article to be scribed and its mounting means can reciprocate relative to the arm. Flexure member 28 allows lateral flexing of segment 24 relative to segment 26, such as back and forth along a circular arc in the direction indicated by curved arrows 32 (FIG. 1). The reason for this flexure is to compensate for slight misalignment of a scribe edge 18 on tool 12 to avoid a "tiller effect" as described.

Segment 24 of arm 22 has an elongated slot 34 therethrough and a tool holder 36 is disposed within slot 34 for holding tool 12 in an operative position. Tool holder 36 includes a rigid tube 38 having an inner, cylindrical surface substantially complemental to the outer cylindrical surface of shank 14 with the diameter of tube 38 being sufficient to permit longitudinal movement of shank 14 therethrough. The length of tube 38 is less than that of shank 14.

Figure 2:
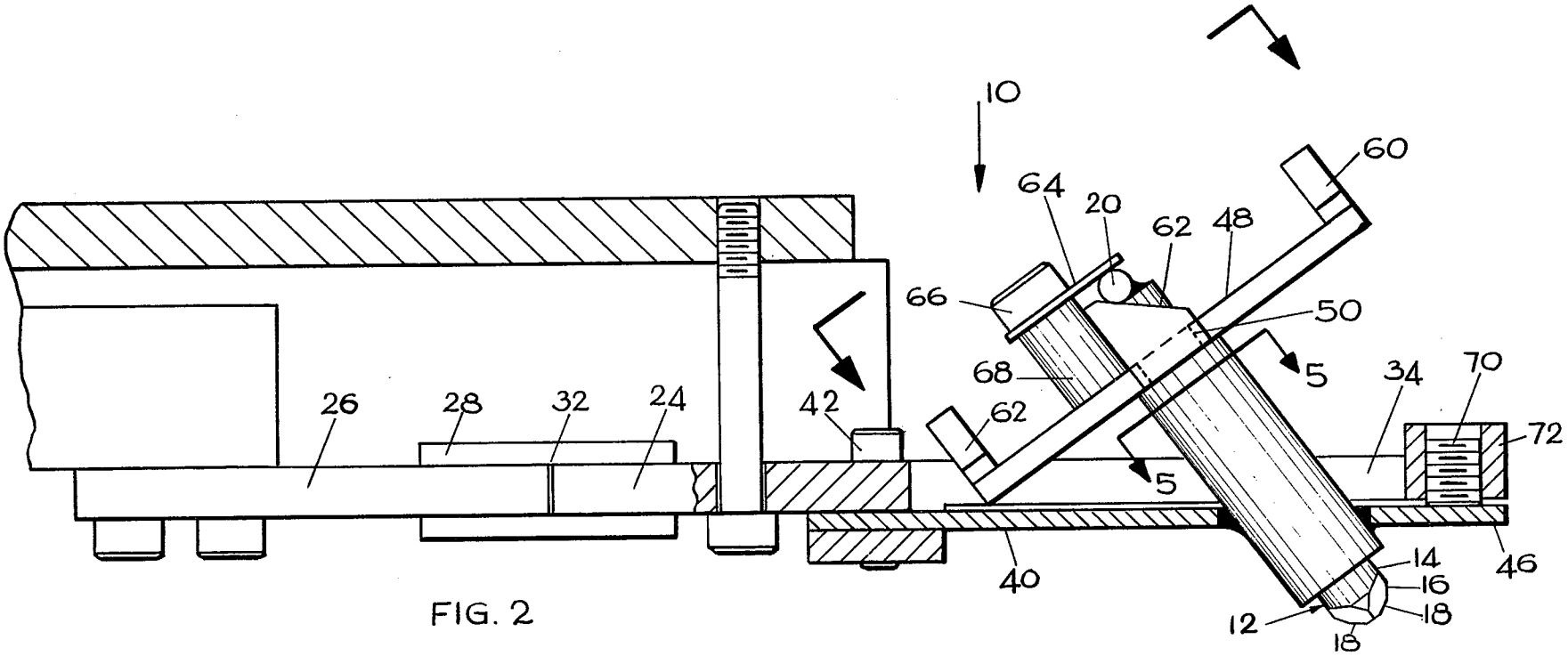
FIG. 2 is a side elevational view, partly in section, of the arm, showing the improved tool and tool mount of this invention.

Tube 38 is rigidly secured in an inclined position to a beam 40, the latter being secured at one end thereof to segment 24 of arm 22 by screws 42 near one end of slot 34. Beam 40 is initially provided with a hole 44 therethrough of elliptical shape as shown in FIG. 1 to accommodate tube 38 so that the tube can extend through beam 40 at an acute angle as shown in FIG. 2. The tube is welded, brazed or soldered to beam 40 and the lower end of tube 38 is near the normally forwardmost end 46 of arm 22 slightly below the lower surface of beam 40 as shown in FIG. 2.

A rigid, flat plate 48 (FIGS. 2 and 4) is rigidly secured to the upper end of tube 38 and has a central opening 50 aligned and communicating with the central bore of tube 38 so that shank 14 of tool 12 can be inserted through plate 48 and extend into and through tube 38. The plane of plate 48 is perpendicular to the central axis of tube 38. Plate 48 has four radial arms 52, 54, 56 and 58 (FIG. 4) which are integral with the plate and are substantially coplanar therewith.

Each of the radial arms of plate 48 has a blocklike projection 60 at the outer end thereof with each projection having an upper surface 62 as shown in FIG. 2, each surface being inclined relative to the plane of plate 48. Surfaces 62 of arms 52 and 56 are in a common plane inclined with respect to the central axis of tube 38. Similarly, surfaces 62 of arms 54 and 58 are in a common plane perpendicular to the plane of the surfaces 62 of arms 52 and 56. Surfaces 62 of diametrically opposed pairs of arms are adapted to be engaged by bar 20 of tool 12 in the manner shown in FIGS. 2 and 4 when the tool shank 14 extends through tube 38. Thus, surfaces 62 serve as stops for the tool and locate the latter relative to the lower end of tube 38 for scribing purposes. Surfaces 62 also determine the orientation of shank 14 and thereby scribe edges 18 relative to the scribe direction represented by arrows 30 (FIG. 1). To hold the tool coupled in the manner shown in FIGS. 2 and 4, a retainer 64 is pivotally mounted by a screw 66 on a post 68 secured to and extending outwardly from plate 48 as shown in FIG. 2. Retainer 64 is pivotal into and out of its operative position shown in FIGS. 2 and 4 in which it overlies and engages bar 20 to hold the same on respective pairs of surfaces 62.

Inclination of tube 38 can be adjusted by changing the initial position of beam 40 relative to arm 22. To this end, a screw 70 is threadedly mounted in a sleeve 72 rigidly secured to and generally perpendicular with one end of arm 22. The lower end of screw 70 bears against the upper surface of beam 40 so that, by moving screw 70 downwardly, beam 40 can be caused to flex downwardly and thereby decrease the angle of tube 38 with respect to the vertical. Movement of screw 70 in the opposite direction will have the opposite effect on the inclination of tube 38.

Figure 4:
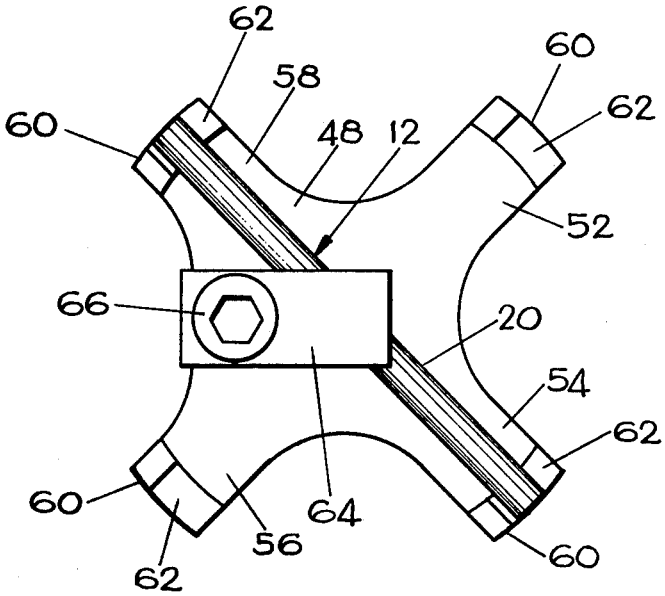
FIG. 4 is a view of the tool mount looling in the direction of line 3—3 of FIG. 2.

In use, tool 12 is inserted into tube 38 until bar 20 engages a respective pair of surfaces 62 as shown in FIGS. 2 and 4. Then, retainer 64 is moved into overlying relationship to bar 20 to retain the tool in place. When so arranged, a scribe edge 18 will be properly aligned with respect to the scribe direction (arrows 30 of FIG. 1). Then, movement of the arm 22 relative to the article to be scribed can commence and can continue until it is deemed necessary to change to a new scribe edge 18. When this is required, retainer 64 is pivoted away from bar 20, the tool is then lifted slightly and turned 90° so that bar 20 can become aligned with and be lowered into engagement with the second pair of surfaces 62, then retainer 64 is moved back into the position shown in FIGS. 2 and 4, overlying the bar to retain the tool in place. Then, scribing can be started again and continued until it is required to change the third scribe edge and so on.

Figure 6:
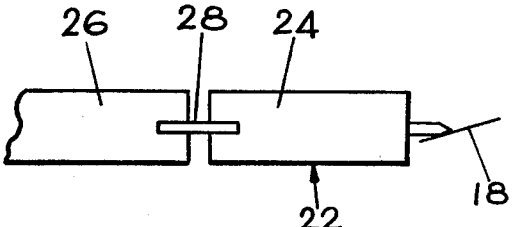
FIGS. 6 and 7 are schematic views of the floating arm, showing the unflexed and flexed positions thereof.
Figure 7:
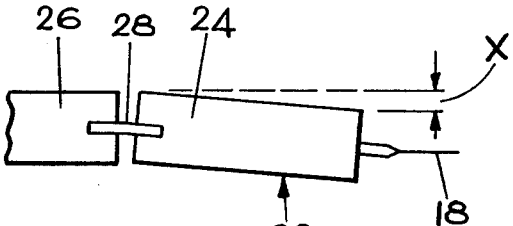

In the event that a scribe edge 18 is slightly askew to the orientation of bar 20 on shank 14, such as might result during manufacture of the tool, the movement of scribe edge 18 during a scribe operation will result in a "tiller effect", causing flexure member 28 to flex to one side or the other until segment 24 is pivoted sufficiently to cause the scribe edge to move parallel to the desired scribe direction. This, is shown schematically in FIGS. 6 and 7, wherein FIG. 6 shows the unflexed condition of segment 24 with a scribe edge 18 at an acute angle relative to the scribe direction 30 (FIG. 1) and FIG. 7 shows the flexed condition of segment 24 with the scribe edge parallel to the scribe direction 30 (FIG. 1). The distance X (FIG. 7) indicating displacement of segment 24 and can be as much as 0.0004 inch without undesirable effects. At the end of the scribing of each line, segment 24 returns to its position shown in FIG. 1 relative to segment 26.

During use of the tool, its inclination can be changed by changing the initial position of beam 40 relative to arm 22. This is accomplished by adjusting screw 70.

I claim:

1. A mount for a scribing tool of the type having a shank provided at one end with a cylindrical cross bar and at the opposite end with a diamond head having a scribe edge comprising: an arm adapted to be movable in a predetermined scribing direction relative to an article to be scribed; and a tool holder on the arm for movement therewith relative to said article, said tool holder having means for positioning the shank of the tool and inclined surface means for engaging the cross bar of the tool and orienting the same and thereby the scribe edge of the diamond head relative to said scribe direction.

2. A mount as set forth in claim 1, wherein said arm includes a pair of spaced segments and a flexure device interconnecting the segments and permitting one segment to move relative to the other segment laterally of said scribe direction.

3. A mount as set forth in claim 1, wherein said positioning means includes a tube for receiving the shank of the tool, said surface means including structure defining a pair of spaced surfaces coupled with the tube and engageable with said cross bar at a pair of spaced locations thereon.

4. A mount as set forth in claim 3, wherein said structure includes a plate having a pair of diametrically opposed arms, each arm having a projection extending outwardly therefrom, each projection having a surface, the surfaces of the projections being substantially coplanar, the plane of the surfaces being inclined relative to the central axis of the tube.

5. A mount as set forth in claim 4, wherein said plate has a second pair of diametrically opposed arms with each second arm being provided with a projection provided with a bar-engageable surface, the surfaces of the projections of the second arms being coplanar, the plane of the surfaces of the projections of the second arms being inclined relative to the central axis of the tube and substantially perpendicular to the plane of the surfaces of the projections of the first-mentioned arms.

6. A mount as set forth in claim 1, wherein said arm has a slot therethrough, said tool holder including a beam secured at one end to the arm and substantially underlying the slot, said confining means including a tube carried by the beam at an acute angle thereto and extending through the beam and through the slot, and means coupled with the beam for adjusting the position of the same relative to the arm.

7. A mount as set forth in claim 6, wherein said adjusting means includes a screw threadedly coupled to the arm and normally engaging the opposite end of the beam.

8. A mount as set forth in claim 1, wherein is included means coupled with the arm and engageable with the tool holder for adjusting the inclination of the tool relative to the arm when the tool is in the tool holder.

9. In combination: a scribing tool having a shank provided with a diamond head at one end and a cylindrical crossbar near the opposite end; an arm adapted to be movable in a predetermined scribing direction relative to an article to be scribed; and a tool holder on the arm for movement therewith relative to said article, said tool holder having means for positioning the shank of the tool in an operative position and inclined surface means for engaging the crossbar and orienting the same and thereby the scribe edge of the diamond head relative to said scribe direction when said shank is confined in said operative position.

10. A mount as set forth in claim 9, wherein said arm includes a pair of spaced segments, and a flexure device interconnecting the segments and permitting one segment to move relative to the other segment laterally of said scribe direction.

11. A mount as set forth in claim 9, wherein said positioning means includes a tube for receiving the shank of the tool, said surface means including structure defining a pair of spaced surfaces coupled with the tube and engageable with said cross bar at a pair of spaced locations thereon.

12. A mount as set forth in claim 11, wherein said structure includes a plate having a pair of diametrically opposed arms, each arm having a projection extending outwardly therefrom, each projection having a surface, the surfaces of the projections being substantially coplanar, the plane of the surface being inclined relative to the central axis of the tube.

13. A mount as set forth in claim 12, wherein said plate has a second pair of diametrically opposed arms with each second arm being provided with a projection provided with a bar-engageable surface, the surfaces of the projections of the second arms being coplanar, the plane of the surfaces of the projections of the second arms being inclined relative to the central axis of the tube and substantially perpendicular to the plane of the surfaces of the projections of the first-mentioned arms.

14. A mount as set forth in claim 9, wherein said arm has a slot therethrough, said tool holder including a beam secured at one end to the arm and substantially underlying the slot, said comfining means including a tube carried by the beam at an angle thereto and extending through the beam and through the slot, and means coupled with the beam for adjusting the position of the same relative to the arm.

15. A mount as set forth in claim 14, wherein said adjusting means includes a screw threadably coupled to the arm and normally engaging the opposite end of the beam

16. A mount as set forth in claim 9, wherein is included means coupled with the arm and engageable with the tool holder for adjusting the inclination of the tool relative to the arm when the tool is in the tool holder.

17. A scribe tool for a tool mount having a pair of spaced, flat reference surfaces comprising: a shank adapted to be coupled to said mount and having a diamond head secured to one end thereof, said diamond head having a number of spaced scribe edges thereon; and a bar secured to the opposite end of the shank and extending transversely thereof, said bar having a predetermined orientation relative to the scribe edges of the diamond head, said bar further having a pair of spaced cylindrical portions for engaging respective reference surfaces of the mount in line contact relationship therewith when said shank is coupled to the mount.

18. A tool as set forth in claim 17, wherein said diamond head has two pairs of scribe edges, each pair of scribe edges being at least substantially parallel, said bar being at least parallel to one of the pairs of scribe edges and being perpendicular to the other pair of scribe edges.

19. A tool as set forth in claim 17, wherein the bar is transversely circular along it length and projects laterally from the shank in opposite directions.

20. A tool as set forth in claim 17, wherein the shank is secured to the bar intermediate the ends of the latter with the shank being substantially radial to the bar.

21. A method of scribing a surface comprising: providing a scribe tool having a shank, a diamond head at one end of the shank with the diamond head having a number of scribe edges, and a crossbar on the opposite end of the shank, the crossbar being provided with a pair of spaced cylindrical portions thereon and having a predetermined orientation with reference to the scribe edges of said diamond head; moving the cylindrical portions of the crossbar into engagement with respective ones of a pair of spaced, flat reference surfaces spaced from a surface to be scribed; confining the shank of the tool against movement transverse to its longitudinal axis when the cylindrical portions of the crossbar engage said reference surfaces; releasably holding the cylindrical portions of the crossbar against the reference surfaces to prevent longitudinal movement of the shank when a scribe edge of the head engages and scribes a surface to be scribed; moving the tool from a starting position in one direction in scribing relationship to a surface to be scribed to form a scribe line thereon; returning the tool to the starting position after each scribe line has been made; and repeating the tool moving and tool returning steps a number of times until a predetermined number of scribe lines have been formed in the surface to be scribed.

22. A method as set forth in claim 21, wherein is included the steps of releasing the cylindrical portions of the crossbar from engagement with the reference surfaces, rotating the shank through an angle of approximately 90°, moving the cylindrical portions of the crossbar into engagement with a second pair of spaced, flat reference surfaces to orient a second scribe edge for scribing the surface to be scribed, and repeating the confining, holding, tool moving and tool returning steps until a predetermined number of second scribe lines perpendicular to the first-mentioned scribe lines have been formed in the surface to be scribed.

* * * * *